US011766648B1

(12) United States Patent
Hockmeyer

(10) Patent No.: US 11,766,648 B1
(45) Date of Patent: Sep. 26, 2023

(54) ROTOR-STATOR COOLING SYSTEM FOR FEEDSTOCK MIXERS

(71) Applicant: Herman Hockmeyer, Harrison, NJ (US)

(72) Inventor: Herman Hockmeyer, Harrison, NJ (US)

( * ) Notice: Subject to any disclaimer, the term of this patent is extended or adjusted under 35 U.S.C. 154(b) by 19 days.

(21) Appl. No.: 18/058,903

(22) Filed: Nov. 28, 2022

(51) Int. Cl.
*B01F 35/92* (2022.01)
*B01F 27/271* (2022.01)
*B01F 101/18* (2022.01)
*B01F 35/90* (2022.01)

(52) U.S. Cl.
CPC ..... *B01F 35/92* (2022.01); *B01F 27/2712* (2022.01); *B01F 2035/98* (2022.01); *B01F 2101/18* (2022.01)

(58) Field of Classification Search
CPC .. B01F 35/92; B01F 27/2712; B01F 2035/98; B01F 2101/18
USPC ..... 366/149
See application file for complete search history.

(56) References Cited

U.S. PATENT DOCUMENTS 5,820,040 A * 10/1998 Hockmeyer ..... B02C 17/168 241/74
5,973,109 A * 10/1999 Yamazaki ..... B29B 7/82 528/499
7,559,493 B1 * 7/2009 Hockmeyer ..... B02C 17/181 241/74
7,828,234 B1 * 11/2010 Hockmeyer ..... B02C 17/168 241/171
7,883,036 B1 * 2/2011 Cullens ..... B02C 17/168 241/171
8,182,133 B1 * 5/2012 Hockmeyer ..... B01F 27/091 366/310
8,376,252 B1 * 2/2013 Hockmeyer ..... B02C 17/168 241/21
8,733,677 B1 * 5/2014 Villardi ..... B02C 17/181 241/171
9,157,002 B2 * 10/2015 Lopez ..... C09D 11/34
9,597,691 B1 * 3/2017 Hockmeyer ..... B02C 17/1815

* cited by examiner

*Primary Examiner* — Marc C Howell
(74) *Attorney, Agent, or Firm* — Stuart M. Goldstein

(57) ABSTRACT

A rotor-stator cooling system addresses the problem of heat generation and viscosity in feedstock mixers by utilizing a cooling dome which receives recirculating cooling water. The dome is attached above a rotor-stator mixer assembly having rotor and stator elements. Cooling water provides for temperature control to feedstock being drawn into the dome, as well as the feedstock circulating within the mixing tank containing the balance of the feedstock outside the dome. The rotor-stator assembly is cooled as well. In order to increase the feedstock viscosity range in the dome, an auger within a tubular member is added to the drive shaft above the rotor-stator assembly. This enables the velocity of slow-moving feedstock to increase, forcing it into the rotor-stator assembly located below. The feedstock is then further accelerated by the rotor element and forced through the stator element.

5 Claims, 3 Drawing Sheets

ROTOR-STATOR COOLING SYSTEM FOR FEEDSTOCK MIXERS

FIELD OF THE INVENTION

The present invention relates generally to the incorporation of cooling temperature control during the dispersions of liquids, in particular feedstock, in the mixing process.

BACKGROUND OF THE INVENTION

High speed rotor-stator mixer assemblies are capable of producing finer dispersions of solids into liquids than typical saw tooth impellors. This is a result of the trapping of agglomerated particles suspended in a liquid between the high-speed rotating rotor and the stationary stator and then tearing them apart, so they can be separated, in many cases, down to the original particle size. For example, a state-of-the-art roto-stator assembly is described in U.S. Pat. No. 11,110,409, the disclosure of which is incorporated by reference herein.

Nonetheless, while common rotor and stator designs are numerous and mostly effective, they share two significant drawbacks:

1. The intense shear rate created by rotor-stator assemblies generates high heat in feedstock which takes the form of viscous liquids, often containing solid constituents. In many cases, this is an undesirable result.
2. The interference of the stator from the flow generated by the rotor reduces the mixing capability of the assembly, thereby limiting the viscosity range of the feedstock.

SUMMARY OF THE INVENTION

It is thus the object of the present invention to address the problems and disadvantages which result in the detrimental heat buildup and viscosity limitations associated with the rotation of the rotor element in rotor-stator assembles in dispersing feedstock.

These and other objects are accomplished by the present invention, a rotor-stator cooling system which addresses the problems of heat generation and viscosity. The system utilizes an elongated cooling dome which receives recirculating cooling water from a water inlet tube. The cooling dome is located above, circumscribes, and is attached to a rotor-stator mixer assembly comprising a rotor element and a stator element. Cooling water provides for temperature control to feedstock being drawn into the dome, as well as the feedstock circulating within the mixing tank or similar vessel containing the balance of the feedstock outside the dome. The rotor-stator assembly is cooled as well. In order to increase the feedstock viscosity range in the dome, an auger can be added to the drive shaft within a tubular member above the rotor-stator assembly. This enables the velocity of slow-moving feedstock to increase, forcing it into the rotor-stator assembly located below. The feedstock is then further accelerated by the rotor element and forced through the stator element.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
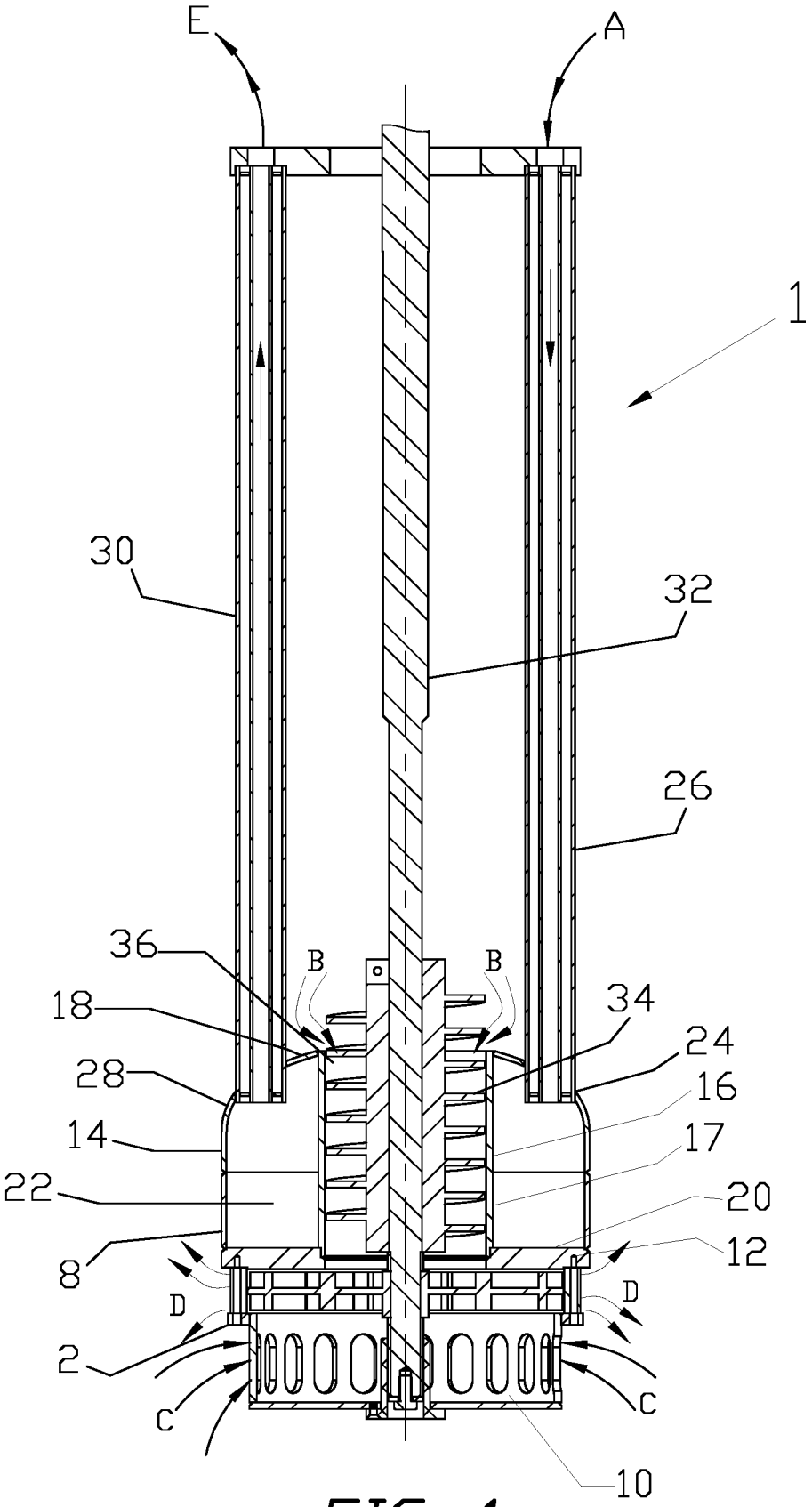
FIG. 1 is a cross-sectional view of the rotor-stator cooling system of the present invention.

The rotor-stator cooling system 1 of the present invention comprises rotor-stator assembly 2 having rotor element 4 and stator element 6. Elongated cooling dome 8 is located above, circumscribes, and is attached to rotor-stator assembly 2 and lower feedstock entry chamber 10 is positioned below the assembly.

Cooling dome 8 comprises bottom base 12 and elongated curved sidewall 14 which surrounds the cooling dome. Centrally located tubular member 16 having sidewall 17 is positioned within cooling dome 8 and extends from top 18 of the cooling dome to top surface 20 of bottom base 12. Cooling chamber 22 is formed between sidewall 17 of tubular member 16 and sidewall 14. Bottom base 12 and curved sidewall 14 of cooling dome 8, and tubular member 16 are specifically fabricated of temperature conductive material. Cooling water inlet port 24 through sidewall 14 provides cooling water to cooling chamber 22 via cooling water inlet tube 26. Return water outlet port 28 through sidewall 14 allows heated water to exit cooling chamber 22 via return water outlet tube 30.

Driveshaft 32 extends through auger component 34, tubular member 16, rotor-stator assembly 2, and lower feedstock entry chamber 10 which is attached to the driveshaft and is supported by stabilizer bearing 46. Upper feedstock entry chamber 36 is formed within the upper section of tubular member 16, between sidewall 17 of tubular member 16 and auger component 34. Driveshaft 32 serves to rotate rotor-stator assembly 2 and auger component 34 within cooling dome 8.

Figure 2:
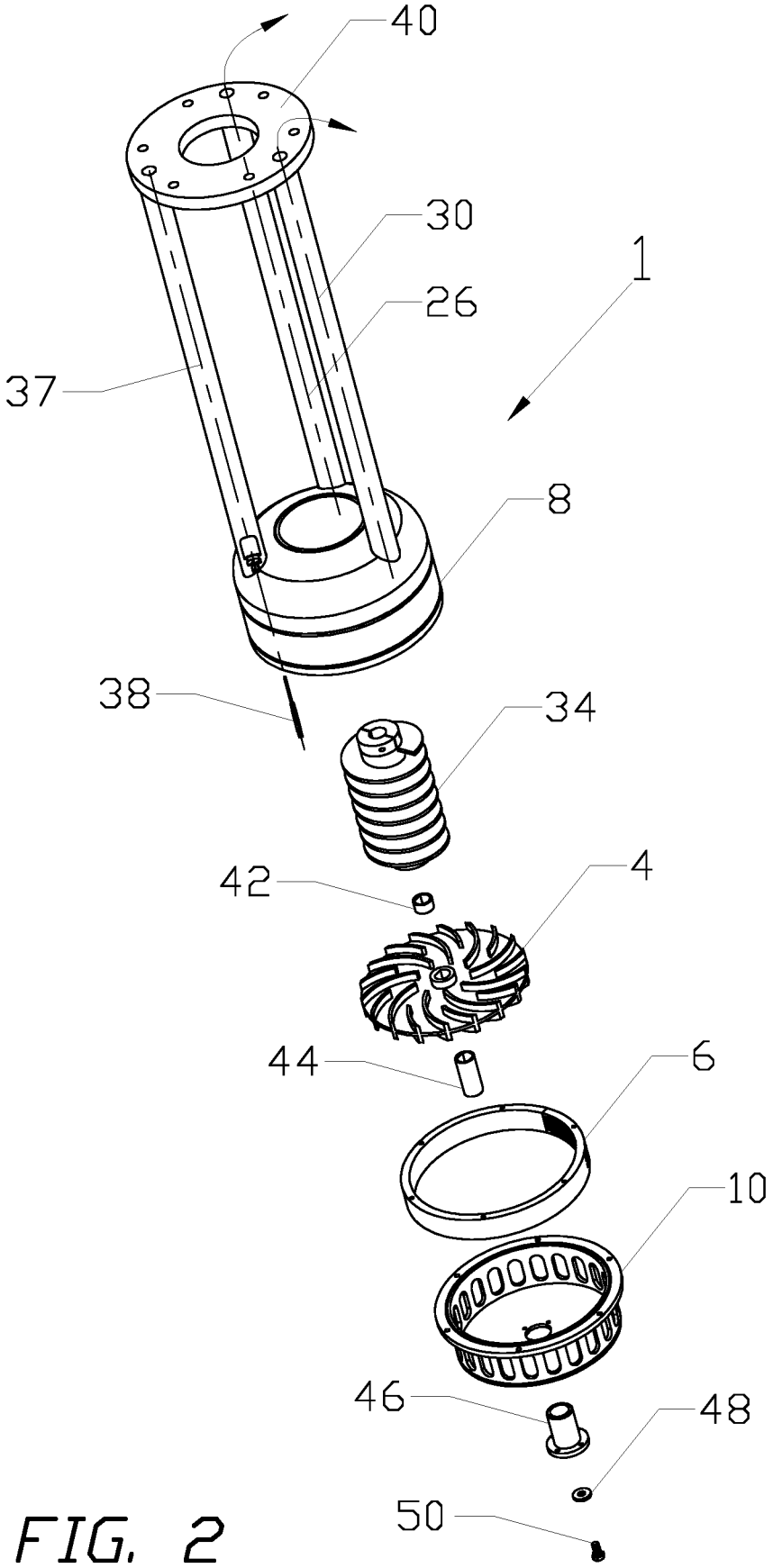
FIG. 2 is an exploded view of components of the rotor-stator cooling system of the present invention.

FIG. 2 shows the alignment of the components of rotor-stator cooling system 1. Water inlet tube 26, return water outlet tube 30, and temperature measuring thermocouple 38 extend from connection flange 40 to cooling dome 8. Thermocouple 38 is located outside of support tube 37 to measure feedstock temperature surrounding the exterior of cooling chamber 22. Spacers 42 and 44 are provided between auger component 34, rotor element 4, stator element 6, lower feedstock entry chamber 10, stabilizing bushing 46, washer 48, and attachment nut 50.

Figure 3:
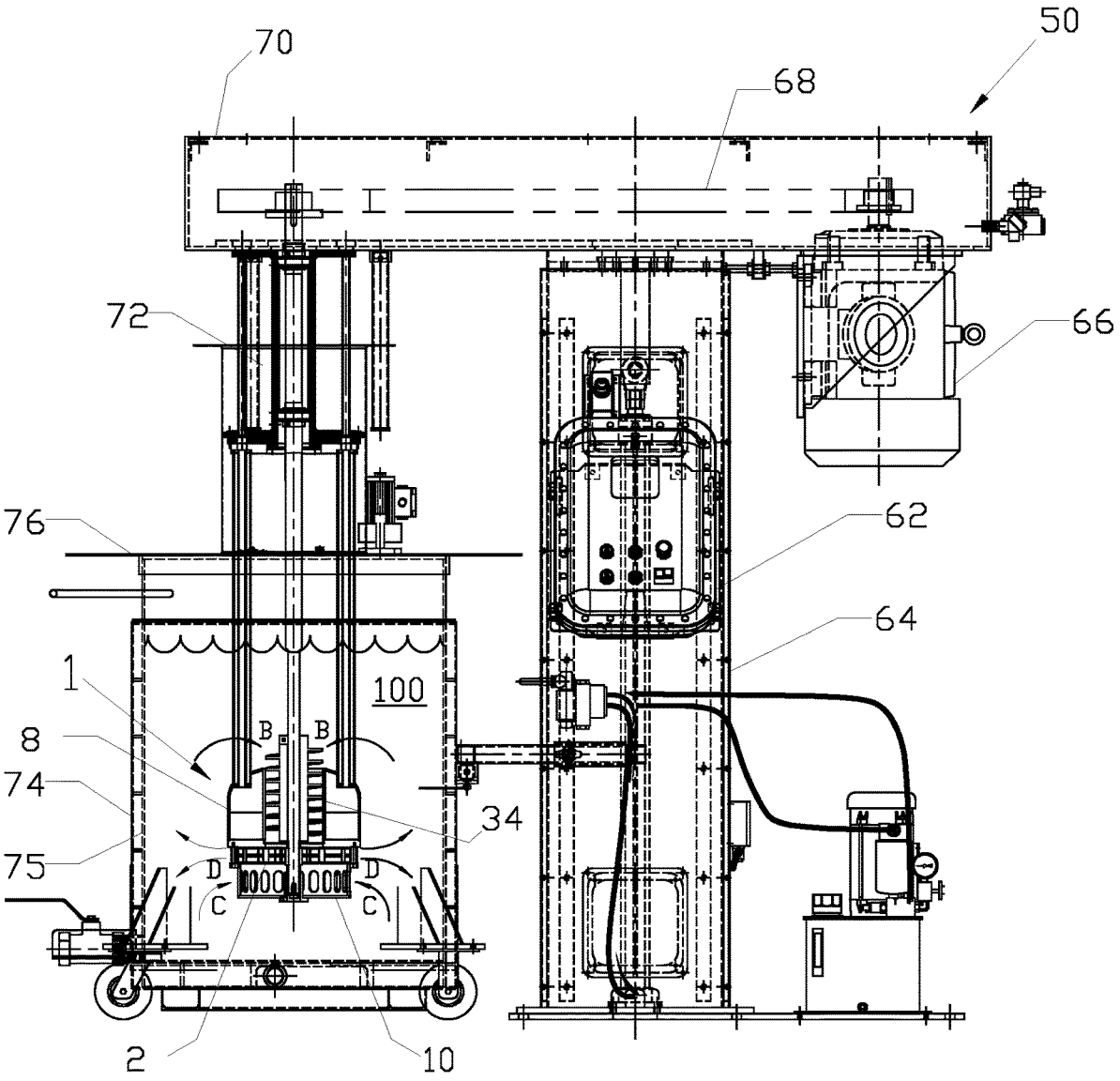
FIG. 3 shows the rotor-stator cooling system of the present invention incorporated in a feedstock mixing apparatus.

FIG. 3 illustrates the placement of the rotor-stator cooling system of the present invention for use in a feedstock mixing apparatus. Feedstock mixing apparatus 50, currently in use, comprises control station 62, hydraulic hoist 64, and means to rotate rotor element 4 of rotor-stator assembly 2 attached to cooling system 1, including motor 66 and the appropriate belt, pulley system 68 in apparatus head 70, and bearing housing 72. Rotor-stator cooling system 1, comprising cooling dome 8, with attached rotor-stator assembly 2, auger component 34, and lower feedstock entry chamber 10, is lowered via hoist 64 into mixing tank 75, where the system is immersed in feedstock 100. Tank 75 has lid 76.

High speed rotation of rotor element 4 of rotor-stator assembly 2 disperses feedstock 100 while generating heat. However, feedstock in tank 75 is cooled as it is drawn into cooling dome 8 and cooling chamber 22 through lower feedstock entry chamber 10 and upper feedstock entry chamber 36. As depicted in FIG. 1, cooling water enters inlet tube 26 at A and flows via inlet port 24 into cooling chamber 22. Cooling water in the cooling chamber serves to lower the temperature of the feedstock entering through upper feedstock entry chambers 36 at B and through lower feedstock entry chamber 10 at C.

Advantageously, added cooling effect is provided to the feedstock, since it comes into direct contact with a number of chilled surfaces, i.e. top surface 20 and elongated curved sidewall 14 of bottom base 12, and sidewall 17 of tubular member 16. All these surfaces staying cool, as their components are made of temperature transferring material, as previously discussed. Feedstock tank 75 can also have jacket 74 for additional cooling if desired. The cooling effects produced in cooling chamber 22 result in the cooling of rotor-stator assembly 2 as well.

Continued flow and recirculation of feedstock received from tank 75 into and through cooling dome 22, out through lower feedstock entry chamber 10 at D, and then returned to the tank, results in the desired feedstock temperature control in the tank, measured and monitored by thermocouple 38. Heated water from cooling chamber 22 ultimately exits the system via return outlet port 28 through return water outlet tube 30 at E.

While it is therefore evident that cooling dome 8, having internal cooling chamber 22, is effective in reducing the temperature of feedstock during the dispersal process, it is contemplated that the cooling dome can also be used as a heating chamber for products which require extreme high heat. For example, heating mediums such as hot oil or steam can be used to raise the temperature of products which demand temperatures in excess of 212 degrees F.

Viscosity range of the feedstock is addressed by auger component 34. An example of the configuration of a representative auger device is described in U.S. Pat. No. 7,175,118, the relevant disclosure of which is incorporated by reference herein. As auger component 34 within tubular member 16 is rotated by drive shaft 32, the auger component compels feedstock 100 in tank 75, to be delivered through upper entry chamber 36, to increase its velocity, forcing it into rotor element 4. The velocity of the feedstock is further accelerated by and forced through stator element 6 in order to return the dispersed feedstock to the surrounding feedstock 100 in mixing tank 75.

In the event the mixing generated by rotor-stator assembly 2 is insufficient to draw feedstock from the internal wall of mixing tank 75, a helical sweeper mixing blade rotating closely to the wall of the mixing tank can be added. This will force a turnover of the feedstock, directing it toward cooling dome 8 and auger component 34, where it will then be drawn into and down the cooling dome to rotor-stator assembly 2. Adjustable scrapers can be added to the helical blade to ensure feedstock is removed from the internal wall of tank 75 and further promote uniformity of the feedstock. This feedstock scraping technology is described in detail in U.S. Pat. Nos. 7,914,200 and 8,182,133, the disclosures of which are incorporated by reference herein.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A rotor-stator cooling system for a feedstock mixing apparatus having a mixing tank, said system comprising:

a rotor-stator assembly for dispersing feedstock, the assembly comprising a rotor element and a stator element;

an elongated cooling dome located above and circumscribing the rotor-stator assembly, the cooling dome comprising a bottom base with a top surface, and an elongated, curved sidewall which surrounds the dome;

a centrally located tubular member within and extending completely through the cooling dome from the top of the cooling dome to the top surface of the bottom base, a cooling chamber inside the cooling dome formed between the tubular member and the sidewall, a cooling water inlet port extending into the cooling chamber for providing cooling water to the cooling chamber, a return water outlet port extending into the cooling chamber for allowing heated water to exit from the cooling chamber, and an upper feedstock entry chamber formed within the tubular member for receiving feedstock;

a lower feedstock entry chamber below and extending down from the rotor-stator assembly for receiving feedstock; and a driveshaft extending through the tubular member for rotating the rotor element of the rotor-stator assembly; wherein when cooling water enters the cooling chamber of the cooling dome upon rotation of the rotor element of the rotor-stator assembly and feedstock from the upper and lower feedstock entry chambers flows into the cooling chamber, the temperature of the feedstock is reduced by the cooling water in the cooling chamber and by the feedstock coming in contact with the cooled top surface of the bottom base, the cooled sidewall, and the cooled tubular member.

2. The system as in claim 1 further comprising:

an auger component located within the tubular member, the driveshaft extending through the auger component for rotating the auger component; wherein upon rotation of the auger component, the velocity of feedstock contacting the cooling chamber is increased and the feedstock is forced into and further accelerated by the rotor element, forced through the stator element, and returned to the surrounding feedstock contained in the mixing tank of the feedstock mixing apparatus.

3. The system as in claim 1 further comprising a cooling water inlet tube through the cooling water inlet port and a return water outlet tube through the outlet port.

4. The system as in claim 1 wherein the top surface of the bottom base, the sidewall of the cooling dome, and the tubular member are made of temperature transferring material.

5. The system as in claim 2 wherein the driveshaft extends through the auger component, the rotor element, and the lower feedstock entry chamber, to rotate these components together.

* * * * *